US008587386B2

(12) United States Patent
Hauff

(10) Patent No.: US 8,587,386 B2
(45) Date of Patent: Nov. 19, 2013

(54) HIGH ISOLATION WAVEGUIDE SWITCH

(75) Inventor: John W. Hauff, Marlborough, MA (US)

(73) Assignee: Raytheon Company, Waltham, MA (US)

( * ) Notice: Subject to any disclaimer, the term of this patent is extended or adjusted under 35 U.S.C. 154(b) by 408 days.

(21) Appl. No.: 13/098,581

(22) Filed: May 2, 2011

(65) Prior Publication Data

US 2012/0280762 A1 Nov. 8, 2012

(51) Int. Cl.
*H01P 1/10* (2006.01)
*H01P 5/12* (2006.01)

(52) U.S. Cl.
USPC ..... 333/106; 333/108

(58) Field of Classification Search
USPC ..... 333/101, 106, 108, 248
See application file for complete search history.

(56) References Cited

U.S. PATENT DOCUMENTS

| | | | | | |
|---|---|---|---|---|---|
| 2,705,776 | A | | 4/1955 | Starr et al. | |
| 2,814,782 | A | | 11/1957 | Zaleski | |
| 2,832,933 | A | | 4/1958 | Greenslit et al. | |
| 3,155,923 | A | | 11/1964 | Persson | |
| 3,419,827 | A | * | 12/1968 | Webb | 333/106 |
| 4,242,652 | A | * | 12/1980 | Shishido et al. | 333/106 |
| 4,649,355 | A | | 3/1987 | Ullman | |
| 5,053,732 | A | * | 10/1991 | Elgass et al. | 333/106 |
| 5,347,243 | A | * | 9/1994 | Kich et al. | 333/106 |
| 5,442,329 | A | * | 8/1995 | Ghosh et al. | 333/21 R |
| 6,218,912 | B1 | | 4/2001 | Mayer | |
| 6,816,026 | B2 | | 11/2004 | Dybdal | |
| 7,330,087 | B2 | * | 2/2008 | Gorovoy et al. | 333/106 |

* cited by examiner

*Primary Examiner* — Dean O Takaoka
(74) *Attorney, Agent, or Firm* — Daly, Crowley, Mofford & Durkee, LLP

(57) ABSTRACT

Embodiments of the invention are directed to a high isolation waveguide switch that can either be manually or mechanically operated. Operation proceeds by loosening a fastener, which draws a rotor portion of the switch away from a stator portion; rotating the rotor by 90 degrees; and tightening the fastener, pushing the rotor into contact with the stator and completing connections to the waveguide ports. Gaskets may provide EMI shielding and ensure port-to-port isolation.

12 Claims, 9 Drawing Sheets

SECTION A-A
SWITCH OPEN

SECTION A-A
SWITCH CLOSED

HIGH ISOLATION WAVEGUIDE SWITCH

FIELD OF THE INVENTION

This invention relates generally to waveguides, and, more particularly, to waveguide switches for use in configuring communications systems.

BACKGROUND

Waveguides and waveguide switches, specifically those switches used to transfer radio frequency (RF) signals propagating through waveguides, as those terms are commonly understood in the RF communications art, are used in many radio frequency (RF) communications applications. Such devices are described in, for example, U.S. Pat. No. 7,330,087 to Gorovoy, et al., issued on Feb. 12, 2008, the disclosure of which is incorporated herein by reference in its entirety.

One typical use of such a switch is for system configuration purposes, meaning that power is not going through the switches while they are being switched. FIG. 1 illustrates a typical dual channel communications system employing waveguide switches 110A, 110B, 110C, and 110D. Each switch has four waveguide ports 111-114, although only port 111 is annotated for drawing clarity. In use, terminal 120A is shown configured to transmit signal input 123A via high power amplifier (HPA) 125A, low band filter 127A, and the vertical polarization of feed 130A. At the same time, also utilizing switch 110A, the horizontal polarization of feed 130A is connected, via high band filter 135A to low noise amplifier (LNA) 137A and then out on receiver output 140A. The other three terminals 120B, 120C, and 120D are similarly configured as shown.

When the operator desires to reconfigure the equipment, as for example, switching terminal 120A to receive on the vertical polarization instead of the horizontal (as shown in solid lines 150), switch 110A is switched to the position shown by grey lines 155. In this configuration, vertically polarized signals at feed 130A are coupled through low band filter 127A to LNA 137A. As can be seen, terminals 120B, 120C, and 120D would also have to be reconfigured for the overall system to operate correctly.

Such exemplary waveguide switches typically have relatively low propagation (or impedance) losses. Such switches, however, typically only provide a limited amount of signal isolation between switch positions. Prior waveguide switches known in the art typically use a central cylinder that rotates in an enclosure. The enclosure has a waveguide port on each side, and the cylinder has paths milled into it to direct the RF energy from port to port. The interface between the outer housing and inner cylinder is the curvature of the cylinder. By definition, these prior art switches require a gap so the cylinder can rotate in the housing. This gap is the reason isolation is limited to levels such as 60 dB for Ku Band (moving up to 80 dB at C band).

Given this limited isolation, typical waveguide switches (known in the art as "baseball" switches, for the position label on top) commonly leak the high power transmit signal (from the HPA) into the sensitive receive chain, thus saturating the LNA and degrading performance. Thus, when using a switch to separate a high power transmit path from a low power receive path, as depicted in FIG. 1, isolation becomes critical. In fact, analysis has shown that isolation values of 110-120 dB can be required in modern communications systems.

The most direct method of providing high isolation is to eliminate switches 110, replacing them with short sections of waveguide bolted together. Isolation can thus be made extremely robust, although at the expense of the time necessary to reconfigure. In order to reconfigure the system, the operator must remove the waveguide sections and reattach them to effect the cross connection. This mechanical reconfiguration involves handling a good deal of discrete hardware (bolts, nuts, washers) and electromagnetic interference (EMI) gaskets, which is both time consuming and difficult in harsh environments. For example, making such a changeover in a failure situation under Arctic weather conditions, using gloves is nearly impossible. Often gaskets get crushed and the hardware gets lost. The typical field technician is increasingly unfamiliar with RF waveguides and therefore the current method can easily be done incorrectly, adding substantial time to the setup.

Another typical prior art method for providing both configuration switching and high isolation is to string four waveguide "baseball" switches together, as shown in FIG. 2. In this implementation, the functionality of switch 110 at its ports 111-114 is provided by the connection of switches 201, 202, 203, and 204. These switches are interconnected with waveguide sections 211, 212, 213, and 214 as shown, using electromagnetic interference (EMI) gaskets and bolts (not shown) at each RF flange 220. Impedance matching loads 230 are required on the fourth port of each switch 201, 202, 203, and 204 in order to ensure the maximum isolation of each switch is achieved. This arrangement doubles the isolation achieved, but requires four switches, four waveguide sections, and four loads. Such an implementation, while widely used, is costly and consumes much real estate on the (typically) cramped system pedestals and other mounting devices.

FIG. 3 shows a plan view of the physical configuration of the switches and waveguides of FIG. 2. Here, the "baseballs" 310 show the signal path configuration of each switch. As shown by lines 312, input 123 is connected to port 111 (via HPA 125, not shown). Switch 201 is configured to couple the signal, via waveguide section 211 to switch 202 and then out on port 112. The cross-connections using waveguide sections 212 and 213 are terminated into loads 230 on both ends, thus providing the necessary isolation.

Switching all four of switches 201, 202, 203, and 204 activates the cross-connections (port 111 to port 113 and port 112 to port 114) over waveguide sections 212 and 213 while simultaneously terminating the straight connections 111 to 112 (via waveguide 211) and 113 to 114 (via waveguide 211) to loads 230.

SUMMARY

What is needed is a simple cross-connecting waveguide switch with very high isolation between ports that can be reconfigured without disassembly, preferably without tools.

In contrast to the above-described conventional approaches, embodiments of the invention are directed to a high isolation (120 dB) waveguide switch that can be manually, mechanically, or electro-mechanically operated. To use it, in one exemplary embodiment, one unscrews a fastener to draw the rotor portion out of the exterior enclosure, rotates the rotor by 90 degrees, and re-secures the fastener. Securing the fastener pushes the rotor back into the enclosure and completes the connections to the waveguide flanges.

One embodiment of the invention is directed to waveguide switch apparatus that uses a rotating cylinder (or drum) as the rotor portion and a fixed waveguide interface portion as a stator. In such an embodiment, the area where the movable portion (rotor) meets the stationary portion (stator) may be essentially planar, with a combination of gaskets and shielding/locating grooves and ribs providing EMI shielding (isolation) between the switched ports. The grooves and ribs key the design so it may be indexed at 90-degree intervals. The ribs also force the two sections, when separated, to be far enough away from the waveguide openings as not to damage them. The waveguide ports, when the switch is closed, may utilize EMI gaskets at each waveguide interface and at the base of each indexing groove for maximum port-to-port signal isolation. A fastener (such as, but not limited to, a wing nut on a threaded rod or central axle) may be used in a manual version of this design to separate the two sections so they may be rotated against each other. In an alternate embodiment, this motion may employ a mechanized linkage and/or a motor drive to open, close, and secure the switch.

Once indexed to the proper position, the fastener (or cam/motor drive) is again used to draw the two sections together and apply a compressive force to the internal EMI gaskets to ensure the maximum obtainable isolation. Since this apparatus may be used outdoors exposed to the elements, it may be fully weatherproof in the closed position, in one exemplary embodiment. When used in a controlled environment, embodiments may omit the environmental (weather) seals. With the gasketing employed, there may be two or more sets of gaskets at each waveguide flange interface, and a gasket at the base of each groove (when grooves are employed). The signal in one waveguide therefore has to get past at least five separate EMI shields to get into the neighboring waveguide. Typical shielding effectiveness of the gaskets is on the order of 100 dB each with ideal compressive forces applied. In one exemplary embodiment, multiple surfaces utilizing compressible EMI gaskets may be provided. Although all surfaces cannot be reasonably machined perfectly with respect to each other, the number of shields and gaskets ensures a repeatable 120 dB of isolation.

In another embodiment, conductive spring pins may be used to act as waveguide inductive posts for even further shielding to break up any possible waveguide transmission modes that may exist in the gaps between the two sections.

In general, the high isolation switch may be configured for use over any RF frequency band by adapting its physical dimensions to those of the waveguides needed through methods well-known in the art. Such changes affect only the size of the waveguide flanges and the dimensions of the switch body to accommodate the typical waveguide dimensions used from L band (1 to 2 GHz) up to and including Q band (33-50 GHz) and beyond, without limitation.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Prior art waveguide switches typically utilize a central cylinder or rotor that rotates in a fixed enclosure, also referred to as a stator. The stator in turn, attaches to the waveguide sections connecting to the rest of the system. The stator enclosure has a number of waveguide ports on its exterior for making the connections. The rotor typically has paths milled into it to direct the RF energy from port to port in each position of the rotor. The interface between the inside surface of the stator housing and outside surface of the rotor is typically defined by the curvature of the rotor's cylinder. In order to be rotable, typical prior art designs require a gap between the rotor and the stator surfaces so that the rotor can move freely within the housing. This gap is the reason isolation is limited to approximately 60 dB at Ku Band frequencies and approximately 80 dB at C band frequencies, for example.

In contrast to the above-described conventional approaches, embodiments of the invention are directed to a high isolation (approximately 120 dB) waveguide switch that can either be manually or mechanically operated. To use it, in one exemplary embodiment, one simply unthreads a relatively large fastener (for example but not by way of limitation, a wing nut), which draws a rotor portion out of the stator's enclosure, rotates the drum by 90 degrees, and retightens the fastener. Tightening the fastener pushes the drum back into the enclosure and completes the connections to the waveguide flanges via EMI gasketing and mechanical contact.

Although a wing nut-type fastener is described, those skilled in the art will realize that fasteners other than a wing nut can be used. Accordingly, the concepts, systems, and techniques described herein are not limited to any particular type of fastener for mating the rotor and stator.

One embodiment of the invention is therefore directed to a waveguide switch apparatus where the moving (rotor) portion meets the stationary (stator) portion along an approximately flat plane and uses a combination of gaskets and shielding/ locating grooves and ribs to provide RF isolation and EMI shielding. In some embodiments, the switch positions may be keyed by the grooves and ribs in order to index the switch position at 90-degree intervals. The ribs also force the two sections, when separated for rotating to a different position, to be far enough away from the waveguide openings so as not to damage them.

Figure 1:
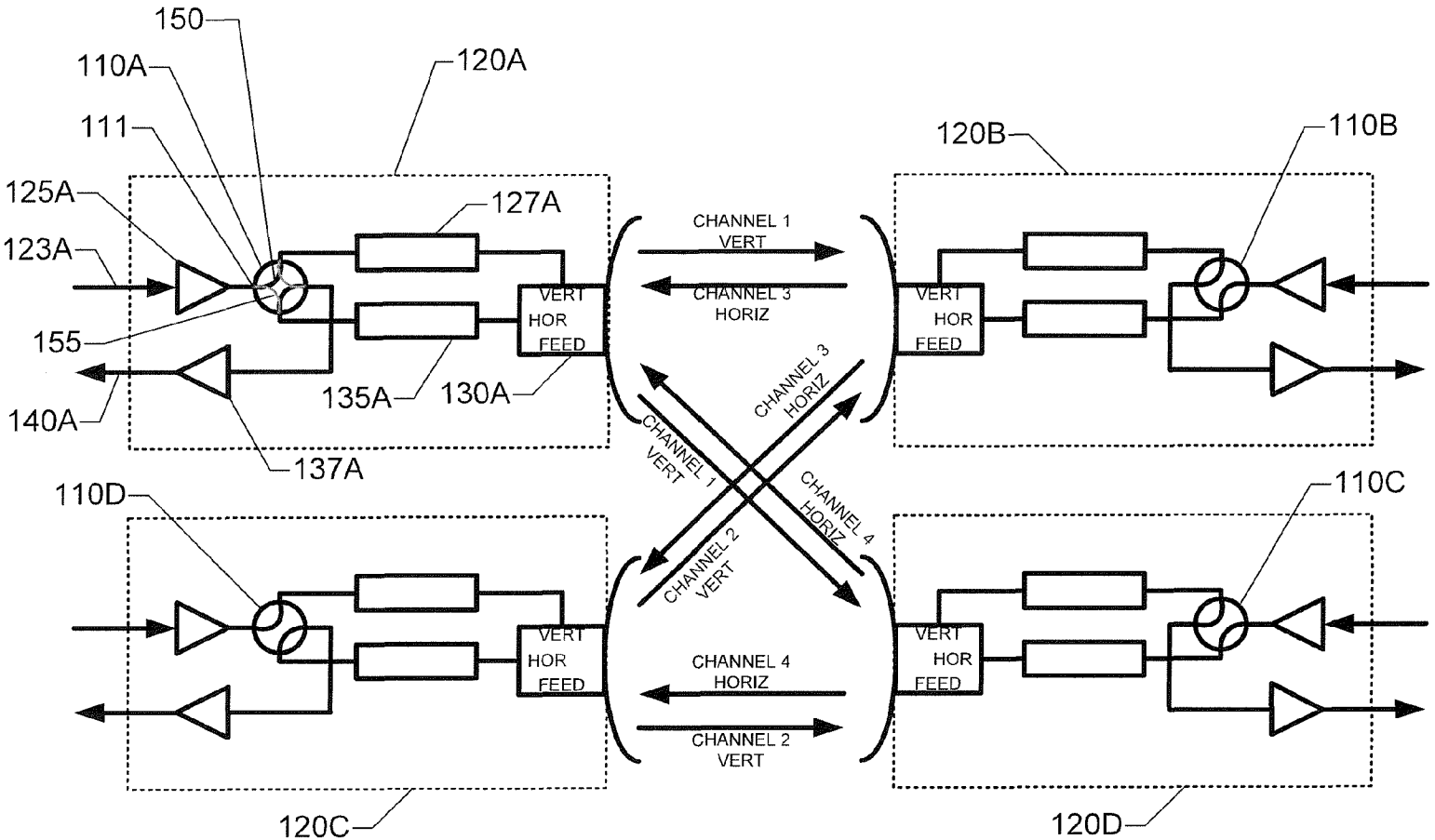
FIG. 1 PRIOR ART
FIG. 1 is a notional block diagram of a prior art four channel communications system utilizing typical low isolation waveguide switches.
Figure 2:
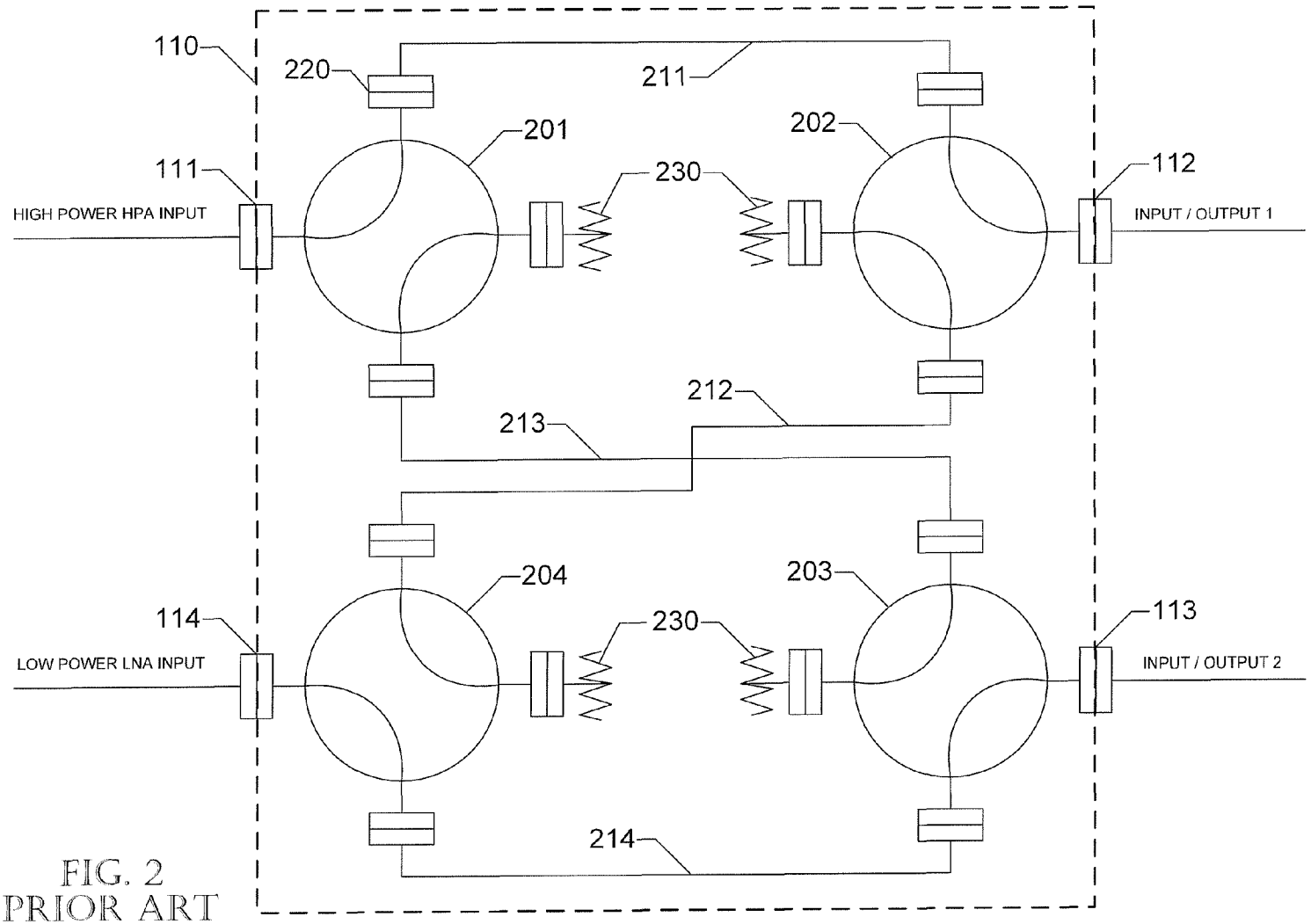
FIG. 2 PRIOR ART
FIG. 2 is a block diagram of a prior art four switch, high isolation assembly for use in the communications system of FIG. 1.
Figure 3:
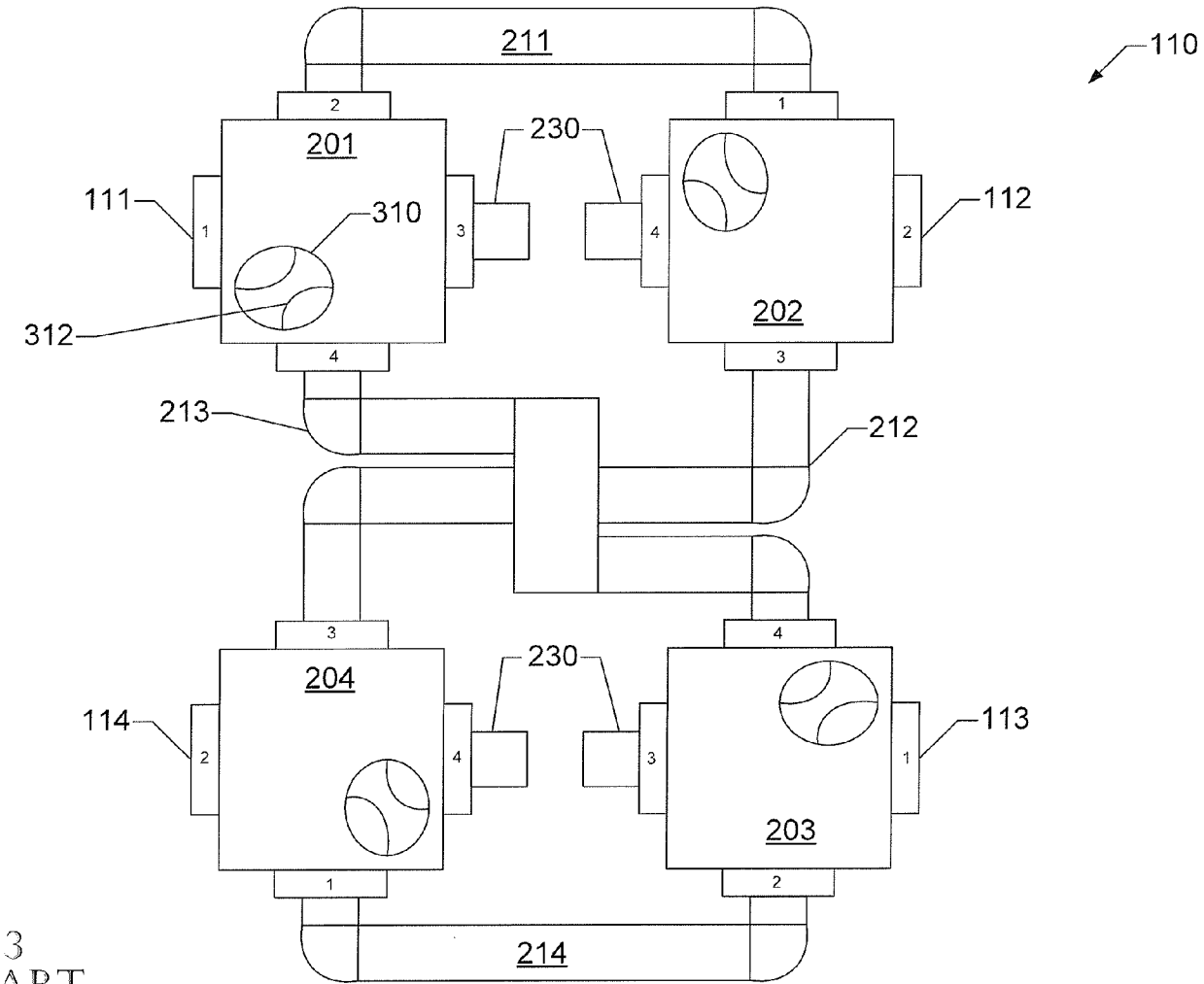
FIG. 3 PRIOR ART
FIG. 3 is a plan view of the prior art hardware typically used in constructing the high isolation assembly of FIG. 2.
Figures 4A, 4B, 5A, 5B:
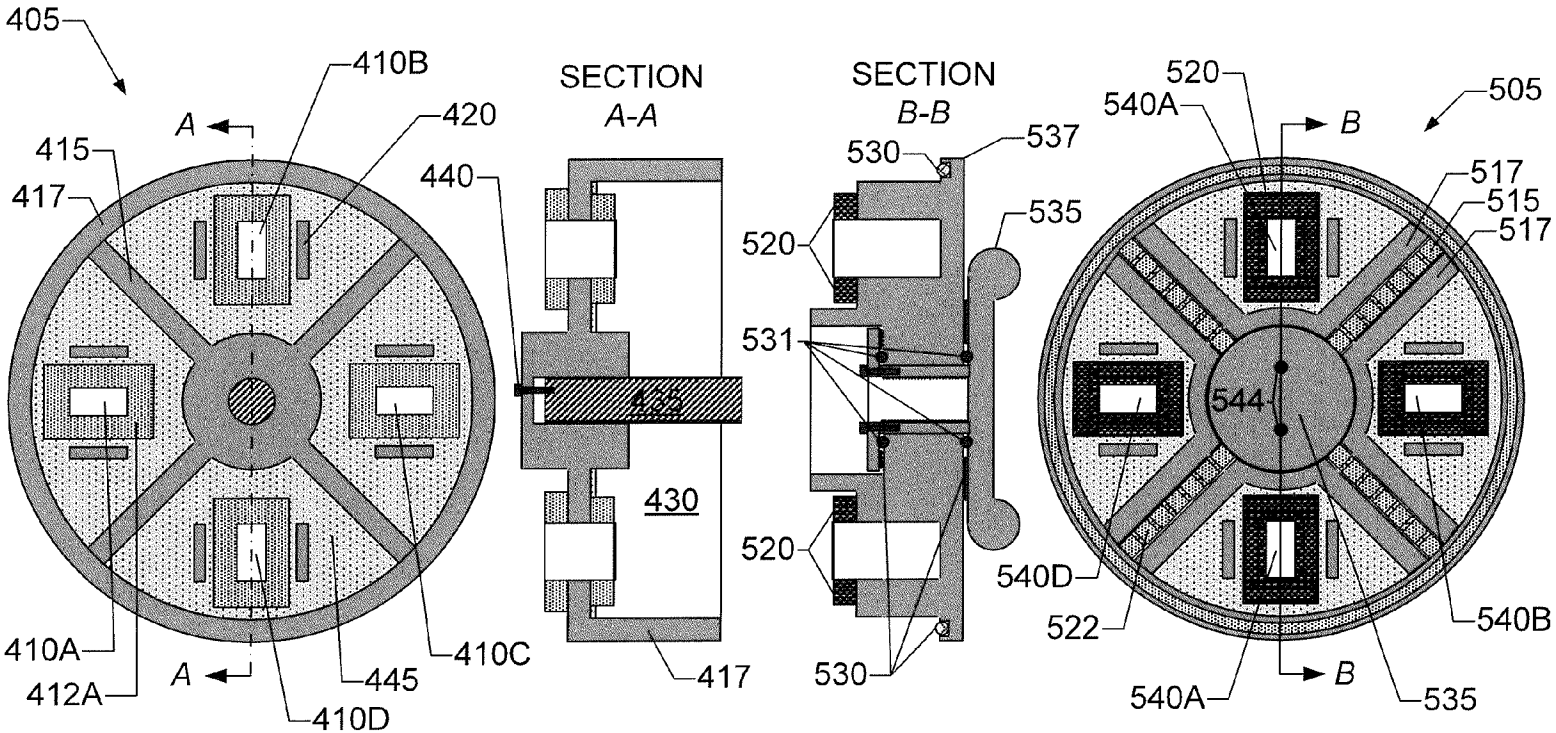
FIG. 4A is a plan view of the interior of the stator portion of a high isolation waveguide switch according to one embodiment of the present invention.
FIG. 4B is a cross section view of the stator of FIG. 4A according to one embodiment of the present invention.
FIG. 5A is a cross section view of the rotor portion of a high isolation waveguide switch according to one embodiment of the present invention.
FIG. 5B is a plan view of the rotor FIG. 5A according to one embodiment of the present invention.

FIGS. 4A and 4B illustrate the stator portion 405 of a waveguide switch constructed according to embodiments of the present invention. FIG. 4A depicts the interior of stator 405. As seen from the interior side, stator 405 comprises (in this exemplary embodiment) of four waveguide ports 410A, 410B, 410C, and 410D, corresponding flanges 412A-412D (only flange 412A is annotated for clarity). Also provided are a plurality of raised ribs 415 and housing 417. Raised ribs 415 and/or compression stops 420 may also be provided to register or locate the rotor relative to the waveguide flanges 412A-412D, providing keying to ensure that the switch may only be configured with the waveguide ports in proper alignment.

Although an approximately round switch housing is described, those skilled in the art will realize that switch housing shapes (including the exterior outlines of the stator and/or rotor) other than cylindrical may also be used. For example, since the location of the waveguide ports in the rotor and stator portions are the most important features with respect to switch operation, as long as the port locations are appropriately spaced relative to each other and the switch can be closed with the necessary EMI seal, the switch body could be octagonal, square, or any other regular or irregular form. Accordingly, the concepts, systems, and techniques described herein are not limited to any particular switch body or housing.

Waveguide ports 410A, 410B, 410C, and 410D are surrounded by EMI gaskets 520 (shown as a component of rotor 505 in FIGS. 5A and 5B). When the switch is closed, EMI gaskets 520 at each waveguide port and EMI gasket 522 at the base of each indexing groove 515 are compressed to provide maximum port-to-port signal isolation. In some embodiments, raised ribs 415 on the stator portion fit into rotor grooves 515 (defined by the rotor's raised ribs 517); EMI gasketing material is shown in groove 515, but one of ordinary skill in the art will appreciate that the gasketing material may be mounted on the mating surface of stator ribs 415 instead. The interior of stator 405 may also be coated (or have installed thereon) an RF absorber 445 to prevent internal reflections.

Indeed, as the use of EMI gasketing is common in RF shielding applications, the present apparatus may incorporate a variety of gasketing and shielding materials in a number of configurations, not further described here, without limitation. It is also understood that the term "rib" should be construed broadly to include any of the typical bracing and reinforcing structures commonly employed in mechanical assemblies subjected to compression forces, including but not limited spars, struts, egg-crate structures, flanges, beams, I- or C-beams and the like.

A simple, hand-operated fastener, such as (in one exemplary embodiment) a large wing nut 535 (shown in FIG. 5A) on a central axle, such as threaded rod 435, may be used in a manual version of this design to separate the two sections so that the rotor 505 may be rotated relative to stator 405. In an alternate embodiment, the opening, rotating to the desired position, and closing motions may be motor driven using conventional drive methods and apparatus well known in the art. It is to be understood that the present invention is not limited to the type of fastener or central axle used; those of ordinary skill in the mechanical arts will appreciate that other fasteners, linkages, cams, and the like, operating around a central axle for alignment, may be used without limitation.

Once indexed to the proper position, fastener 535 is again used to draw rotor 505 into stator 405 and apply a compressive force to the internal EMI gaskets 520 and 522 to ensure the maximum obtainable isolation. In some embodiments, the various EMI shields and gaskets may provide the necessary indexing to ensure that the switch closure results in the correct alignment of the internal channels and ports.

With the gasketing employed as discussed above, there are two pairs of gaskets 520 at each waveguide flange interface 412, and a gasket 522 at the base of each groove 515. The signal in one waveguide therefore has to get past five separate EMI shields to get into the neighboring waveguide. In one exemplary embodiment, gaskets 520 may similar to Laird Technologies part no. 0098-0550-006; gaskets 522 may be Laird Technologies part no. 0097-0941-06, although other types and manufacturers' gaskets may be used without limitation. Typical shielding effectiveness of such gaskets is on the order of 100 dB each with ideal compressive forces applied. Since all surfaces cannot be reasonably machined perfectly with respect to each other, there are several surfaces utilizing some sort of compressible gasket in the design. Employing a number of shields ensures 120 dB of isolation can be repeatably obtained.

In another embodiment, conductive spring pins (also commonly used in waveguide connections) may be used to act as waveguide inductive posts for even further shielding to break up any possible waveguide transmission modes that may exist in the gaps between the rotor and stator.

In some applications, this apparatus may be used outdoors, exposed to the elements. Therefore, the switch may be adapted to be fully weatherproof in the closed position by the use of conventional weather gasketing and sealing methods well known in the art. Hollow core and/or flat elastomeric weather seals 530 (shown in FIG. 5A) are examples of the use of such seals in the WR62 switch embodiment of FIGS. 4 and 5. When such weather seals are employed, in some embodiments, the closed switch may be airtight and thus able to maintain a positive internal pressure. Various other types of common weather seals and pressurization schemes may also be used without limitation, as are well known in the art.

FIG. 4B shows a cross section of stator 405 through line AA for FIG. 4A. (For drawing clarity, the sides of exterior ribs 517 are omitted in this and all other side views herein presented.) Region 430 is the interior cavity into which rotor 505 fits. A central axle, in this exemplary embodiment comprising threaded shaft 435, is secured into stator housing 417 by means of a lock screw 440. Although a cap-head lock screw is depicted, various other captivation methods designed to prevent threaded shaft 435 from rotating may be used. For example, but not by way of limitation, lock screw may be countersunk into housing 417, or the central axle may be a press-fit pin or other more-permanent attachment (see, e.g., the lock pin shown in FIG. 6B). Accordingly, the present invention is not limited to the captivation scheme here depicted. Similar lock pins 544 may also be employed in rotor 505 to secure fastener 535 to the rotor, as shown in FIG. 5B.

FIG. 5A is the corresponding cross section (through line BB of FIG. 5B) of rotor 505. In one exemplary embodiment, weather seals 530 may be employed (through typical means known in the art) to waterproof the movement gaps between fastener 535 and to seal flange 537 where it contacts housing 417 of stator 405. In one embodiment, the interior bore of fastener 535 is adapted to engage threaded shaft 435, thus enabling the fastener to be rotated to screw down (or unscrew) the rotor from the stator. And, since rotor 505 is free to rotate around fastener 535 (on bearings 531, in some embodiments) while it is engaged with threaded shaft 435, changing the position of the rotor to bring a different set of rotor channel openings 540A-540D (shown in the plan view of FIG. 5B, looking into the mating surface of rotor 505) into correspondence with ports 410A-410D.

Although a wing nut is depicted as fastener 535 in some exemplary embodiments, those skilled in the art will realize that graspable fasteners other than a wing nut may be used to open and close a switch constructed according to the various embodiments of the present invention. Accordingly, the concepts, systems, and techniques described herein are not limited to any particular type of closure device. For example, but not by way of limitation, a motor and/or a linkage may also be used to separate the rotor and stator and rotate the rotor around the central axle. Such an embodiment would allow for remote operation in hostile environments such as the vacuum of space.

FIG. 5B shows the mating surface or underside of rotor 505 in more detail. Here, the "wings" (graspable portions) of wing nut 535 are omitted for clarity.

Figure 7B:
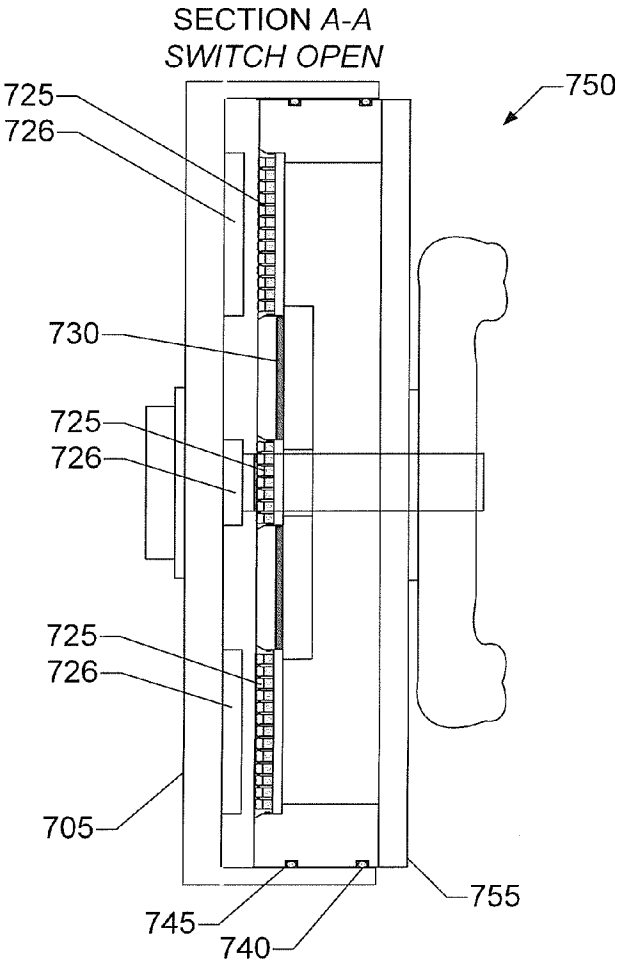
FIG. 7B is a cross section view of the assembled high isolation waveguide switch of FIG. 7A in the open position.
Figure 7A:
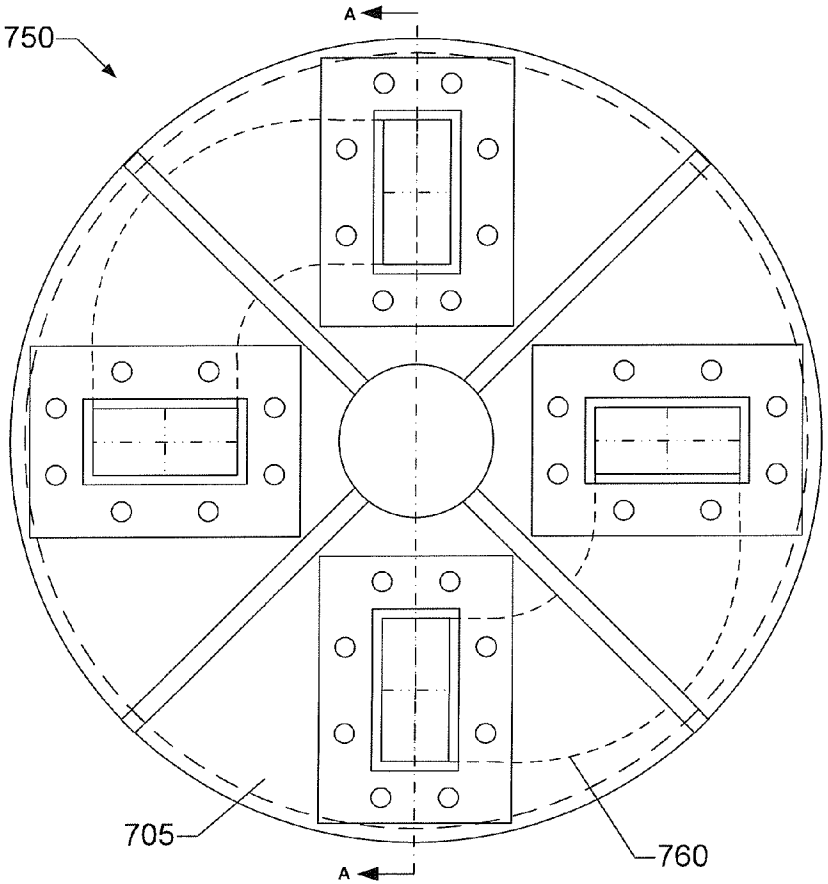
FIG. 7A is a plan view of the exterior of the stator portion of a high isolation waveguide switch according to an alternate embodiment of the present invention.
Figure 8B:
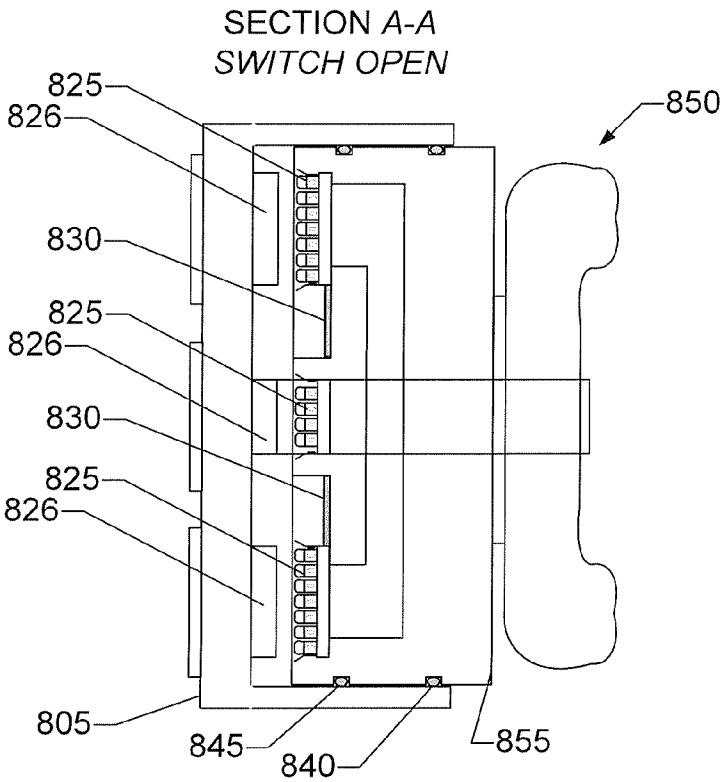
FIG. 8B is a cross section view of the assembled high isolation waveguide switch of FIG. 8A in the open position.
Figure 8A:
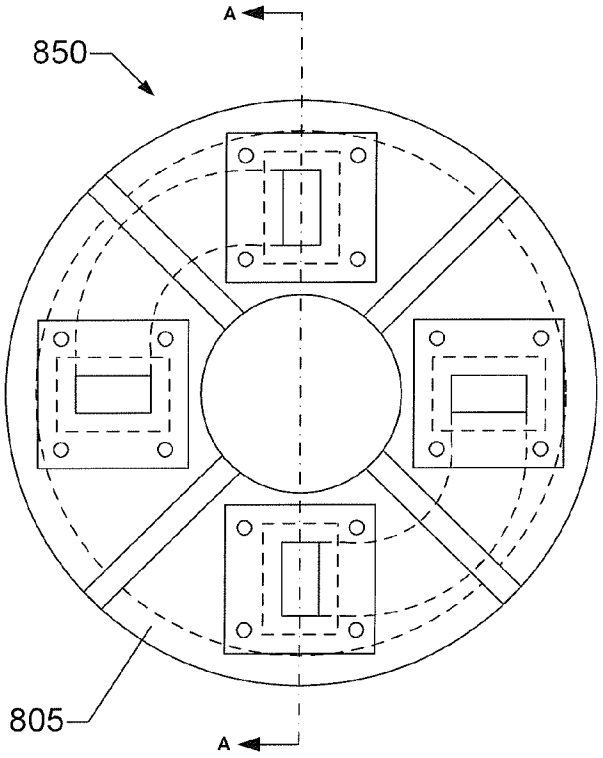
FIG. 8A is a plan view of the exterior of the stator portion of a high isolation waveguide switch according to a further alternate embodiment of the present invention.

While FIGS. 4 and 5 depict a waveguide switch adapted for use with WR62 waveguides (and therefore operable in the 12-18 GHz band), one of ordinary skill in the art will appreciate that other configurations for use with different size waveguides are equally enabled by this disclosure. In general, the present high isolation switch may be configured for use over any RF frequency band by adapting its physical dimensions to those of the waveguides needed through methods well-known in the art. Such changes affect only the size of the waveguide flanges and the dimensions of the switch body to accommodate the typical waveguide dimensions used from L band (1 to 2 GHz) up to and including Q band (33-50 GHz) and beyond, without limitation. Indeed, FIGS. 7A and 7B illustrate an alternate embodiment sized for use with WR187 waveguide. FIGS. 8A and 8B illustrate a further alternate embodiment sized for use with WR75 waveguide.

Figure 6C:
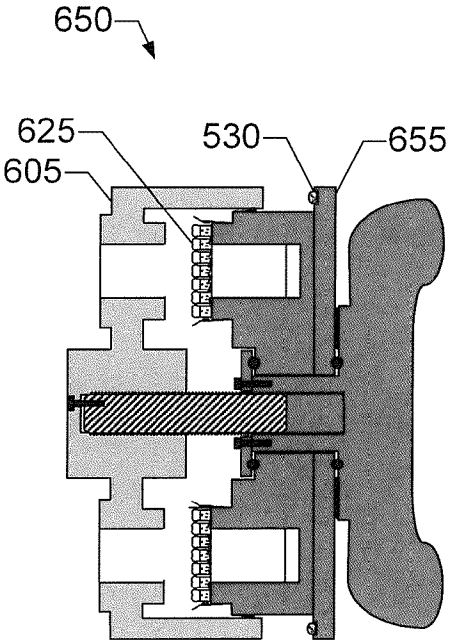
FIG. 6C is a cross section view of the assembled high isolation waveguide switch of FIG. 6B in the open position.
Figure 6B:
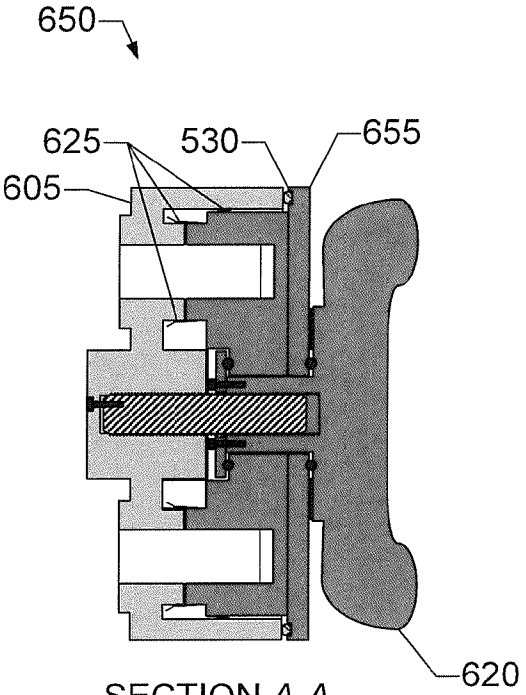
FIG. 6B is a cross section view of an assembled high isolation waveguide switch of FIG. 6A in the closed position.
Figure 6A:
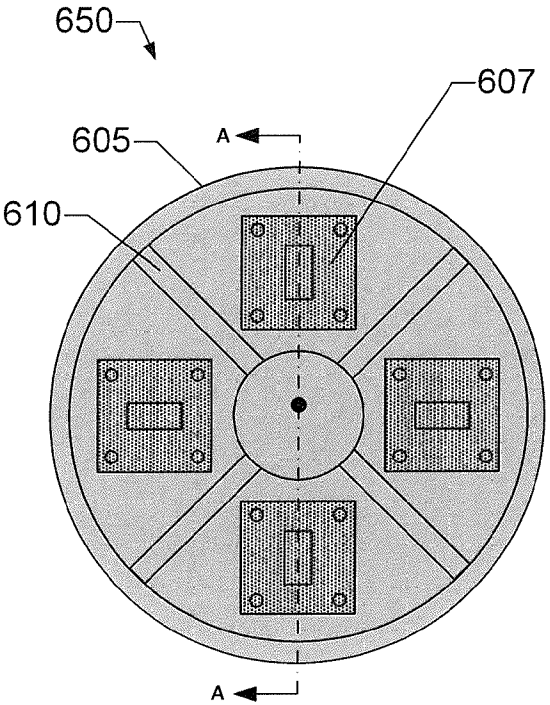
FIG. 6A is a plan view of the exterior of the stator portion of a high isolation waveguide switch according to an alternate embodiment of the present invention.

Turning to FIGS. 6A-6C, the operation of an alternate embodiment of a high isolation switch 650 is further described. FIG. 6A depicts the external side of a stator 605 showing four typical WR62 waveguide mounting flanges 607. Stiffening ribs 610 may be provided in a radial or similar pattern to reinforce the stator. Alternatively (as is true with all embodiments presented herein), when stator 605 is constructed of a sufficiently rigid material, stiffening ribs 610 may be reduced in number, configuration, size, or even eliminated.

FIGS. 6B and 6C depict switch 650 in the closed and opened positions, respectively, along line AA of FIG. 6A. In this embodiment, fastener 620 is rather larger than that depicted in FIG. 5A. In this exemplary embodiment, EMI shielding is provided in part by beryllium copper springs 625, shown when closed in FIG. 6B and in the opened position in FIG. 6C.

In FIGS. 7A and 7B, another variation on the configuration of the present waveguide switch is illustrated, in this case a switch 750 adapted for use with WR187 waveguide. FIG. 7A depicts the stator side of assembled switch 750. Dashed lines 760 illustrate the approximate location of the waveguide channels within rotor 755. FIG. 7B depicts switch 750 in the opened position. Beryllium copper springs 725 around waveguide flanges 726 and compliant EMI gasket material 730 on the inside surfaces of rotor 755 may be used to provide isolation shielding. Also, in addition to weather gaskets 740, EMI O-ring gaskets 745 may be provided between the stator 705 and rotor 755.

FIGS. 8A and 8B illustrate a further variation on the configuration of the present waveguide switch, in this case a switch 850 adapted for use with WR75 waveguide. In this exemplary embodiment, beryllium copper springs 825 around waveguide flanges 826 and compliant EMI gasket material 830 may be used on rotor 855 (shown in the opened position in FIG. 8B). As above, these gaskets and shields provide isolation shielding. Also, in addition to weather gaskets 840, and EMI O-ring gasket 845 may be provided between the stator 805 and rotor 855.

In all of these representative embodiments, the high isolation waveguide switch may be constructed from any of number of conductive materials known and used in RF communications, such as but not limited to, stainless steel, aluminum, copper, beryllium, and various alloys thereof. Such parts may be machined using techniques known to a skilled artisan. Accordingly, the materials and methods of fabricating these parts are not further discussed herein.

In some embodiments, the waveguide interface or flange may comprise a single machined part. Likewise, the rotor portion may comprise a single machined part or two or more machined parts brazed together. In various embodiments, the threaded shaft may be a fine thread, stainless steel stud firmly mounted in the stator and extending in to the rotor. Also, as noted above, reinforcement ribs and/or similar structures may protrude out of either the exterior or interior side (or both) of the stator. Variations on the mechanical construction methods and materials suitable for use in RF and hostile environments are well known in the art; accordingly, the present invention is to be understood as encompassing all such variations without limitation.

In some embodiments, when reinforcing ribs are present on the interior (proximate) face of the stator, grooves in the rotor may be disposed to accept the ribs when the rotor is brought into contact with the stator for alignment/registration and/or EMI shielding. Furthermore, the grooves may have EMI gaskets at the bottom disposed to make contact and form an EMI shield with the ribs. Alternatively, the EMI gasketing material may be disposed on the ribs to the same effect. In addition, RF absorbing material may be used throughout the interior of the switch, by means well known in the art.

In some exemplary embodiments, the grooves and ribs may serve many salutary purposes. For example, the ribs add rigidity to the waveguide interface (namely the stator) so that a single tightening screw (i.e., the fastener and threaded rod, in some embodiments) may be utilized to bring the rotor into secure contact with the stator. Additionally, the ribs and grooves enforce separation of the rotor from the stator when open and during rotation to preclude damaging the waveguide interfaces and the EMI shielding devices. Finally, the ribs and grooves provide precise alignment of the waveguide ports when the rotor and stator are joined together.

Figure 9A:
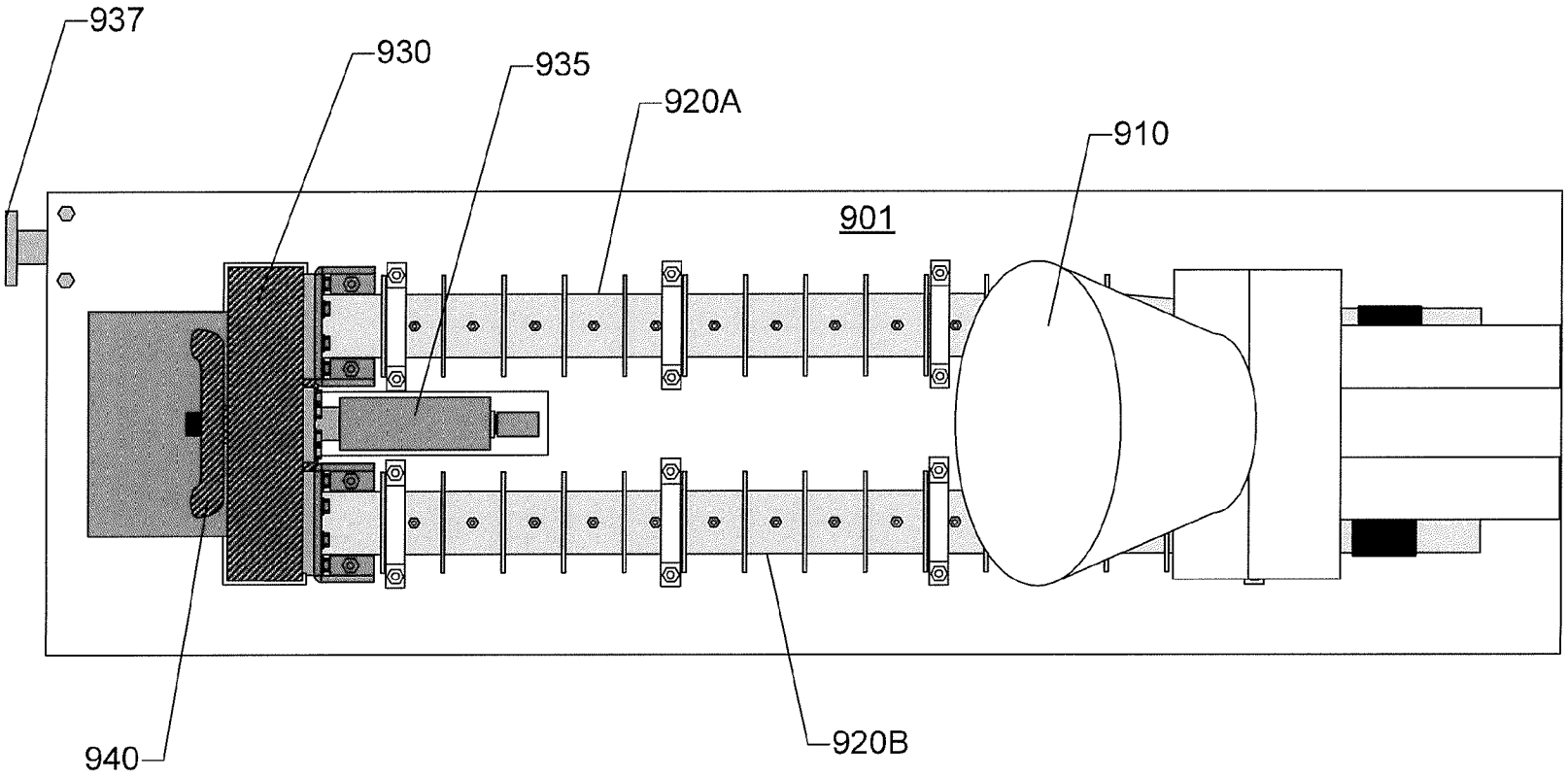
FIG. 9A is a plan view of a high isolation waveguide switch mounted as part of an antenna front-end assembly.
Figure 9B:
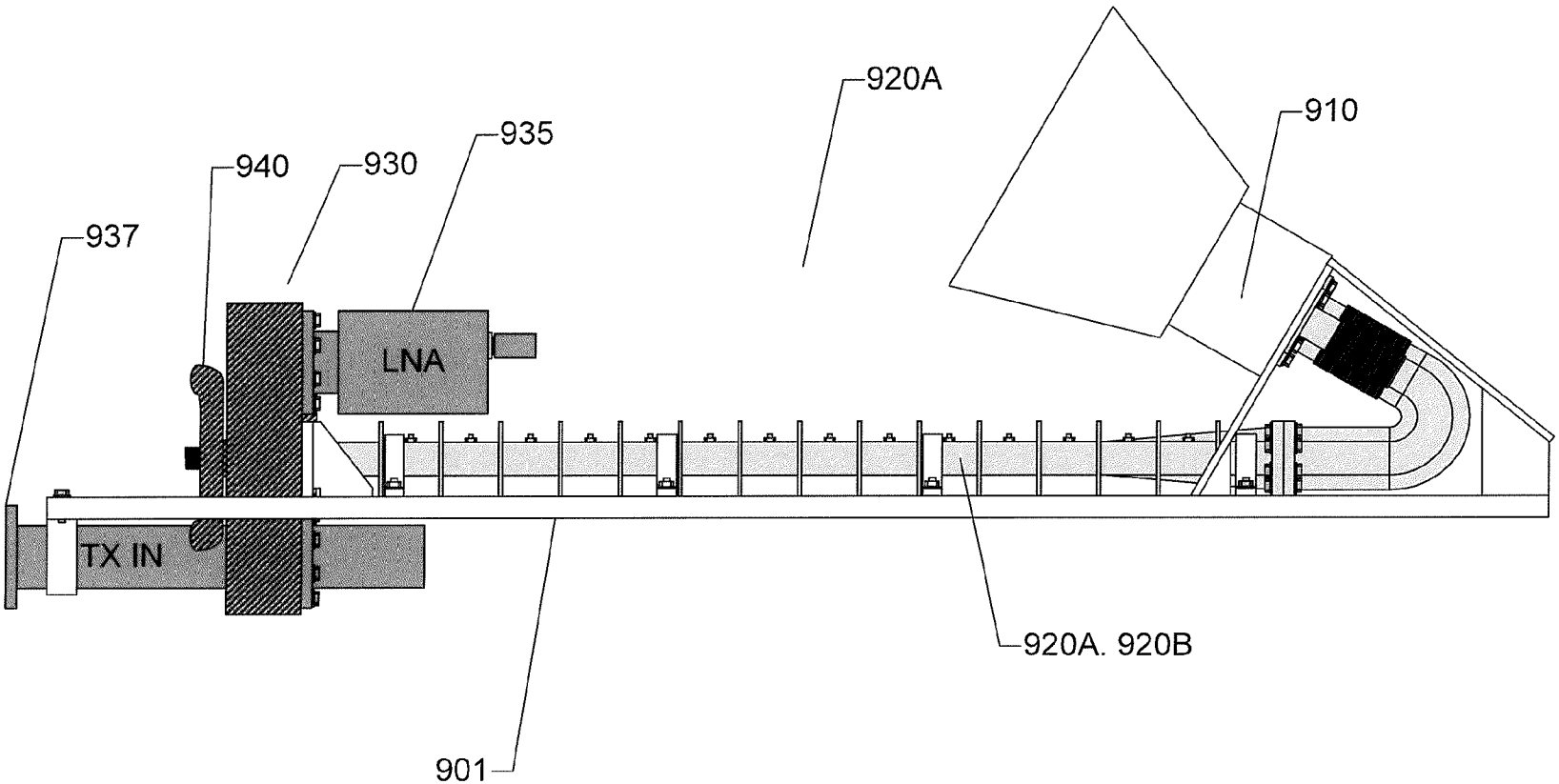
FIG. 9B is an elevation view of the antenna front-end assembly of FIG. 9A.

FIGS. 9A and 9B illustrate a typical application of the inventive waveguide switch in use in an antenna front-end assembly. Here, the two channels from feed horn 910 are conducted, by means of waveguide filters 920A and 920B to switch 930. The other two ports of switch 930 are coupled to LNA 935 and transmit manifold 937. Operation of wing nut 940 allows a technician to rapidly reconfigure which of the feed horn channels (or polarizations) are coupled to each of the LNA 935 and transmitter manifold 937. In one exemplary embodiment, all of these front-end components are mounted on a common shelf or other substrate 901. Other mounting configurations will be readily apparent to one of ordinary skill in the art and, accordingly, are not further described herein.

While particular embodiments of the present invention have been shown and described, it will be apparent to those skilled in the art that various changes and modifications in form and details may be made therein without departing from the spirit and scope of the invention as defined by the following claims. Accordingly, the appended claims encompass within their scope all such changes and modifications.

I claim:

1. A high isolation waveguide switch having a closed position and an open position, comprising:

a stator having a proximate side and a distal side, said stator further comprising:

a first, second, third, and fourth port uniformly spaced around said distal side and extending through said stator, each of said ports further comprising a mounting flange on said distal side configured to attach to a waveguide;

a central axle having a proximate end and a distal end, said central axle centrally located on and perpendicular to said proximate side of said stator and fixedly attached thereto by said distal end of said central axle;

a rotor having a fastener rotably attached thereto and adapted to engage the proximate end of the central axle, said rotor further comprising:

a proximate side;

a distal side;

a first channel and a second channel disposed within said rotor, each configured to conduct electromagnetic energy along its length, wherein said first channel connects from the first port to the second port and said second channel connects from the third port to the fourth port when the rotor is in a first orientation, and said first channel connects from the second port to the third port and said second channel connects from the first port to the fourth port when said rotor is in a second orientation; and where said fastener opens and closes said high isolation waveguide switch, wherein when in said open position said rotor freely rotates around said central axle and when in said closed position said shielding surfaces contact said stator to form a plurality of EMI shields between said first channel and said second channel.

2. The high isolation waveguide switch of claim 1, further comprising a plurality of RF absorbing surfaces disposed upon at least one of said proximate side of said stator and said distal side of said rotor.

3. The high isolation waveguide switch of claim 1, wherein said fastener is adapted to securely attach to said central axle.

4. The high isolation waveguide switch of claim 3, wherein said fastener comprises a wing nut and said central axle is threaded to receive said wing nut.

5. The high isolation waveguide switch of claim 1, wherein said fastener further comprises a linkage and clamp adapted to securely attach to said central axle.

6. The high isolation waveguide switch of claim 1, wherein said fastener is motor-operated.

7. The high isolation waveguide switch of claim 6, wherein said motor-operated fastener further comprises a wing nut and said central axle is threaded to receive said wing nut.

8. The high isolation waveguide switch of claim 6, wherein said motor-operated fastener further comprises a linkage and clamp adapted to securely attach to said central axle.

9. The high isolation waveguide switch of claim 1, wherein said plurality of EMI shields further comprises at least one of a gasket, a spring, and a finger.

10. The high isolation waveguide switch of claim 1, further comprising a plurality of stiffeners disposed upon at least one of said proximate side of said stator and said distal side of said stator.

11. The high isolation waveguide switch of claim 1, wherein when in said closed position, a positive internal pressure is maintained.

12. The high isolation waveguide switch of claim 1, wherein when in said closed position, said plurality of EMI shields index said ports in each said orientation.

* * * * *